United States Patent [19]

Beasley et al.

[11] Patent Number: 5,007,540

[45] Date of Patent: Apr. 16, 1991

[54] PERSONAL CARE PACKAGE

[75] Inventors: John C. Beasley, Dallas, Tex.; Pierre F. Dinand, Levallois, France

[73] Assignee: Stuart Jacobson Associates, Inc., Dallas, Tex.

[21] Appl. No.: 511,974

[22] Filed: Apr. 17, 1990

Related U.S. Application Data

[63] Continuation of Ser. No. 179,236, Apr. 8, 1988, abandoned.

[51] Int. Cl.[5] ..... B65D 69/00; B65D 21/00

[52] U.S. Cl. ..... 206/581; 215/10; 206/38; 206/504; 206/813

[56] References Cited

U.S. PATENT DOCUMENTS

| | | | |
|---|---|---|---|
| 1,277,253 | 8/1918 | Paschal | 220/23.4 X |
| 2,663,450 | 12/1953 | Bourcart | 206/581 X |
| 2,764,309 | 9/1956 | Zelonka | 220/23.4 |
| 3,385,465 | 5/1968 | Bliss | 220/23.4 |
| 4,165,812 | 8/1979 | Jennison | 220/23.4 X |
| 4,194,619 | 3/1980 | Schley | 220/23.4 X |
| 4,770,292 | 9/1988 | Handler | 220/23.4 |

FOREIGN PATENT DOCUMENTS

| | | | |
|---|---|---|---|
| 002410 | 6/1979 | European Pat. Off. | 215/10 |
| 2235839 | 1/1975 | France | 220/23.4 |
| 31334 | 11/1920 | Norway | 220/23.4 |
| 158164 | 2/1921 | United Kingdom | 220/23.4 |
| 649541 | 1/1951 | United Kingdom | 220/23.4 |

*Primary Examiner*—William I. Price

*Attorney, Agent, or Firm*—Kenneth R. Glaser

[57] ABSTRACT

A package of personal care commodities comprised of a plurality of separate containers each charged with a supply of a care commodity and sectionally configured individually as a triangular truncated wedge. The individual containers are capable of being arranged and detachably retained together in a nested relation when assembled to collectively form either a compact enclosing package unit of square cross-section or a relatively flat section that can be conveniently stored or hand carried for travel.

5 Claims, 3 Drawing Sheets

PERSONAL CARE PACKAGE

This is a continuation of co-pending application Ser. No. 07/179,236 filed on Apr. 8, 1988 now abandoned.

TECHNICAL FIELD

The field of art to which the invention pertains comprises the art of portable kits for carrying personal care effects when traveling.

BACKGROUND OF THE INVENTION

Most persons, on extended travel for more than at least one day, tend to carry with them everyday personal care items such as various toiletries utilized in their daily grooming and hygiene routines. By placing the individual packaged items in luggage, handbags, briefcases, dopp kits, tote bags or the like, the items conveniently accompany the traveler and are available at the travel destination when needed.

As a general rule, the packaging for such items are of a rectangular or circular cross-section and of an arbitrary dimension determined by the manufacturer of the item. When a collection of such items are placed together for travel, they rarely if ever lend themselves to any degree of compactness for efficient use of, or compatability with, available storage space. To the contrary, the various packagings tend to consume considerably more space than should otherwise be required under circumstances where space is normally at a premium because of limitations on luggage capacity. Moreover, it is virtually impossible to maintain the packagings together in any form of unitized selective grouping.

DESCRIPTION OF THE PRIOR ART

Personal care items used by persons for everyday grooming or hygiene represent a vast and highly competitive market. Many of these items such as shampoo, mouthwash, perfume, creams, lotions, etc., are in liquid form; many, such as talc, powdered soap, etc. are in powder form; but all are used routinely on a daily basis by the consumer. As such, all of these items complement each other in the consumer's grooming routine; thus it preferred to have them commonly placed. Notwithstanding, the individual prior art containers for the various items are not normally susceptible to complementary packaging or nesting, whereby these items can be more conveniently and collectively carried and stored when traveling. The usual approach to the problem has been to select luggage or other carriers sufficiently large to accommodate the various and sundry items without regard to the storage inefficiency which results.

ASPECTS OF THE INVENTION

It is therefore an important aspect of the invention to provide a novel personal care package whereby various personal care items can be collectively toted as a unit in a selected conveniently carried geometric configuration.

It is a further important aspect of the invention to effect the previous aspect by means of like complementary nested packaging for each of the individual care items so that when collectively assembled, they form a substantially unitized structure of a desired complementary geometric configuration.

It is a still further important aspect of the invention to effect the preceding aspects with novel packaging which, when assembled, compactedly complement each other in an interengaging contiguous relation effecting said selected geometric configuration and precluding inadvertent content leakage.

SUMMARY OF THE INVENTION

This invention relates to packaging for several personal care items. More specifically, the invention relates to individual packaging for various personal care items to be carried, the packaging being so configured to form a close fitting, substantially unitized, carrying structure from which each of the individual packagings can be selectively removed and replaced as desired.

For achieving the foregoing, the packaging hereof is comprised of a plurality of bottle-like containers into which the respective care items have been or are to be individually inserted. Each container bottle, including a removable cap, has matching surfaces for juxtaposed postioning with the others and in a preferred embodiment is cross sectionally and dimensionally identical to the others. Each could, for example, have a substantially flat exterior and be of generally oval section. Alternatively they could be constructed in section trapezoidally as a triangular truncated wedge. For the latter, the base of the wedge, which can be arcuate or flat, represents an exterior face of the unitized package, when assembled, and which extends substantially parallel with an interior face defining the truncation of the wedge. The latter, when assembled, is adapted to confront and surround an elongated tubular post-like container having a polygonal periphery complementing the interior sections defined by the collective wedge truncations thereat. Alternatively, they can be assembled oppositely staggered and interfitted so as to result in a more flattened elongated configuration.

On at least the juxtaposed angled surfaces of adjacent bottles there is provided fastener means in the form of complementary stitch and loop fabric strips similar to that marketed under the trademark Velcro. When assembled, using for example four individual containers bottle shaped in the manner hereof, they are collectively retained nested together by the fastener strips in an assembled relation appearing as a unitized rectangular box of square cross-section which can be conveniently stored and carried. In the alternative elongated embodiment, the containers are similarly nested and retained together for storage and carrying. With a minimum of effort, one or more bottles in either arrangement can be removed as desired and then restored to the assembly in a matter of seconds, after dispensing of content from the selected bottle has been completed. During the assembled relation, the individual bottle caps, being similarly shaped as the bottles on which they are placed, effectively interlock with each other to preclude rotation. This affords the added benefit of preventing leakage when nested for travel.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
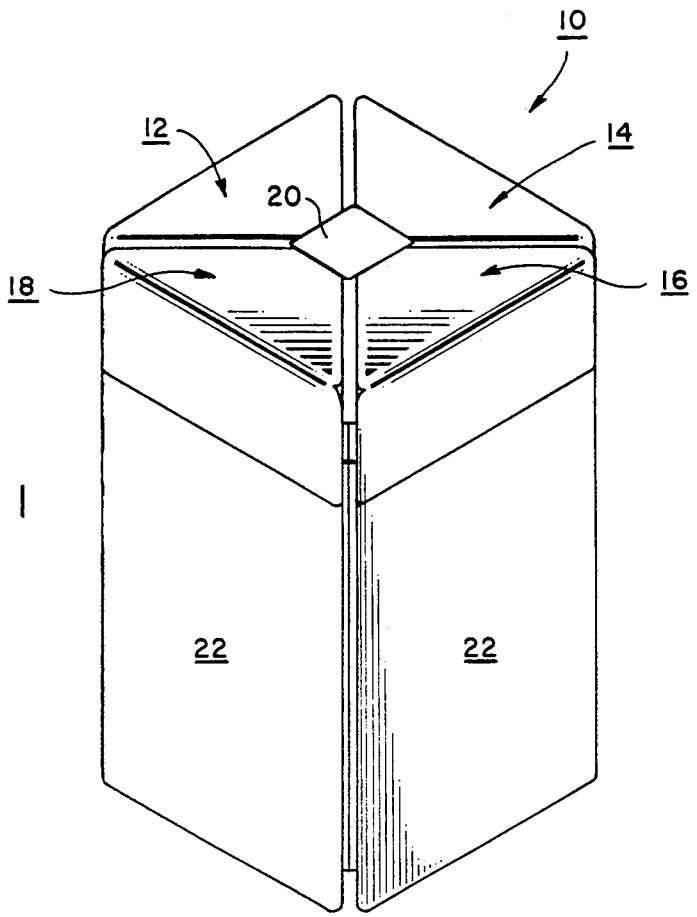
FIG. 1 is a perspective elevation of the assembled personal care package hereof in a first embodiment.
Figure 2:
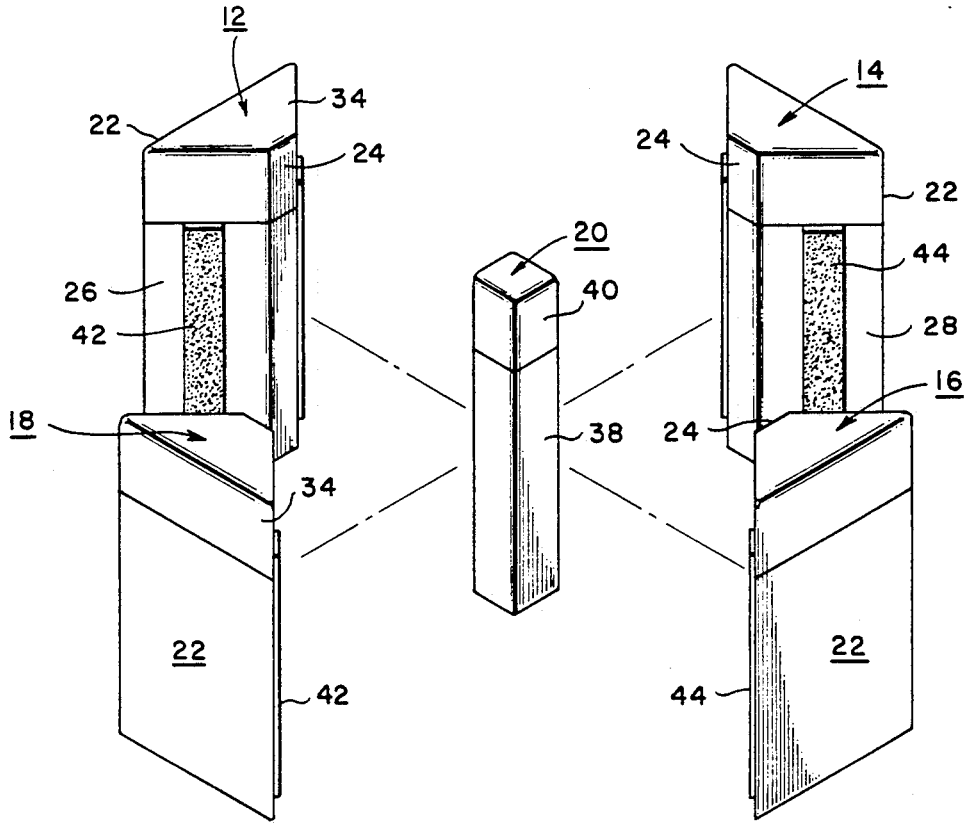
FIG. 2 is an exploded perspective view of the individual container bottles comprising the personal care package hereof.
Figure 3:
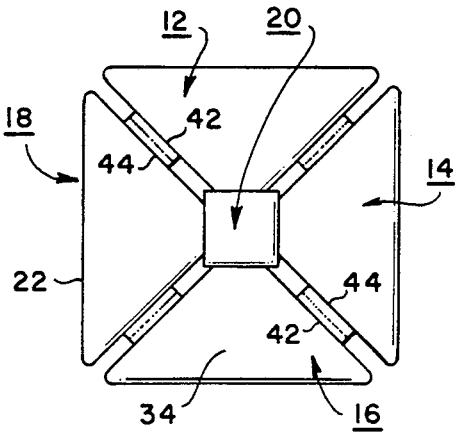
FIG. 3 is a top plan view.
Figure 6:
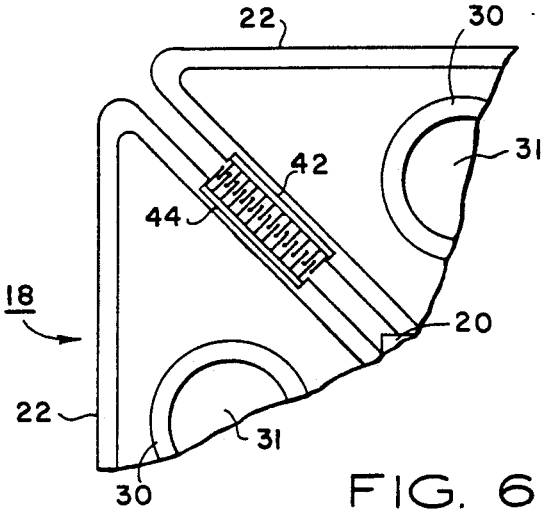
FIG. 6 is a fragmentary enlarged plan view of assembled bottles juxtaposed in the package hereof as seen substantially from the position 6—6 of FIG. 5.
Figure 4:
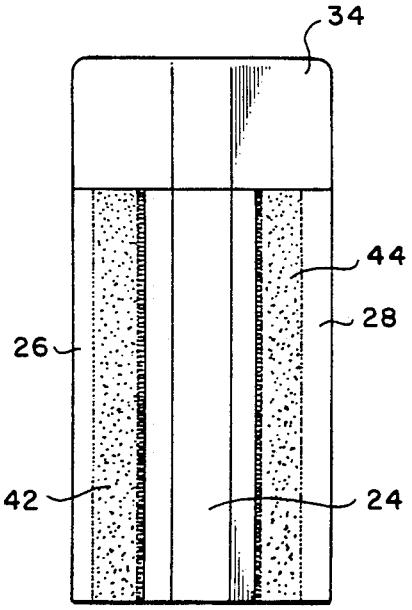
FIG. 4 is a front elevation of an individual container bottle when capped.
Figure 5:
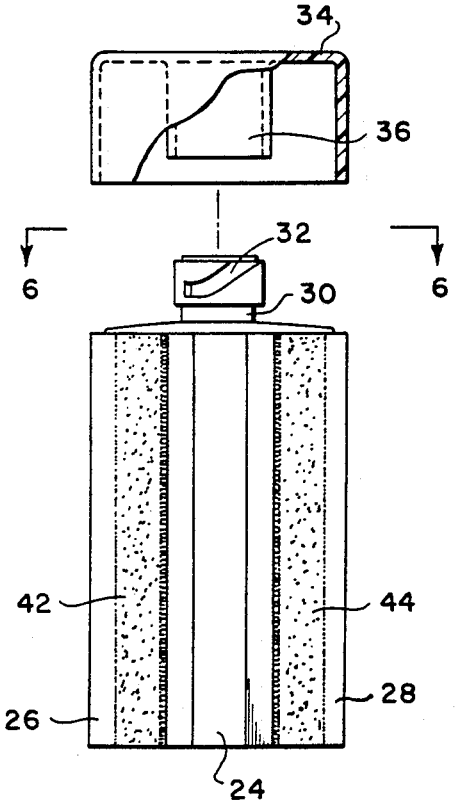
FIG. 5 is a front elevation similar to FIG. 4 of a bottle container hereof when uncapped.

In the description which follows, like parts are marked throughout the specification and drawings with the same reference numerals respectively. The drawing figures are not necessarily to scale and the proportions of certain parts may have been exaggerated for purposes of clarity.

Referring now to FIGS. 1–6 of the drawings, the assembled package hereof in the first embodiment hereof is designated by the reference numeral 10 and, as best seen in FIG. 1, appears as an elongated rectangular unit of squared cross-section. Comprising package 10 are four individual and separable bottle-like shaped containers 12, 14, 16 and 18 adapted to be removably retained nested in the assembled relation shown in FIG. 1 surrounding a narrow elongated bottle-like container 20.

Each of the exterior bottles are geometrically and dimensionally identical and, when totalling four in number as in the preferred embodiment, they potentially each occupy a quadrant of the squared section comprising the assembly. For that purpose, each of the individual bottles are constructed trapezoidally as a triangular truncated wedge extending from a base 22 representing an exterior face of the assembly of FIG. 1. The interior distal face 24 extends substantially parallel to face 22 and the two faces are oppositely joined by the opposite triangular side faces 26 and 28.

For dispensing the personal care commodity from any of the bottles, each bottle includes a pour neck 30 having a helical groove 32 about its exterior for receipt and retention of an interfitting removable cap 34. Depending on the type of commodity wet or dry within each of the bottles, an appropriate pour orifice (not shown) may be inserted in or over the opening of neck 30. Each cap, for aesthetic continuity, is formed in section and in dimensional correspondence with the truncated wedge of the bottle on which it is to be supported. Depending centrally downwardly from the underside of the cap 34 is a sleeve enclosure 36 containing a cooperable interfit (not shown) with neck groove 32 to enable opening and closing the bottle when desired. By selective positioning of groove 32, rotating cap 34 on neck 30 to the closed position effects surface registration and continuity between the corresponding exterior bottle and cap surfaces thereat. Being that the wedge shaped caps respectively interlock against rotation when in their assembled nested relation, they are precluded from rotation and thereby prevent leakage when nested for travel.

Narrow bottle or tube container 20, adapted to be centrally surrounded by the bottle containers, is of a polygonal periphery having a number of like sides 38 complementing the number and angle of end faces 24 to be confronted. Like the exterior bottles, tube 20 includes a removable cap 40 so as to expose an internal compartment (not shown) in which a toothbrush or other suitable type personal item or commodity can be readily inserted and removed when needed.

In order to assemble and disassemble individual bottles from the package of FIG. 1 for gaining access to the personal care commodity therein, there is provided longitudinally extending along each side face 26 and 28 a length of strip fastener 42. Such strip fasteners may, for example, be of the hook and loop fabric of the type marketed under the trademark Velcro, and are centrally positioned vertically along the side faces whereby strip 42 on a face 26 of one bottle complements and attaches to the strip 42 on a side face 28 of the adjacent bottle to be assembled thereto. In this manner all four bottles can be individually assembled to each other by the mere placement thereof in juxtaposition, enabling the complementary strips 42 to retain them in that juxtaposed relation until they are separated.

The individual exterior bottles along with their respective caps and tube 20 are preferably formed of a polymeric plastic composition whereby they can be readily molded inexpensively to the desired shape and to any selected color. They preferably are similarly sized for a selected volume content depending on the weight and quantities of the individual personal care items to be packaged. The commodity items likely to be contained in the various bottles can be powders such as talc or soap or liquids such as perfume, shampoo, mouthwash, hair bleach, creams, lotions, etc. The preferred quantities can reasonably be greater for a three week trip than for a three day trip, and consequently the bottles can be functionally sized and merchandised to suit.

Figure 7:
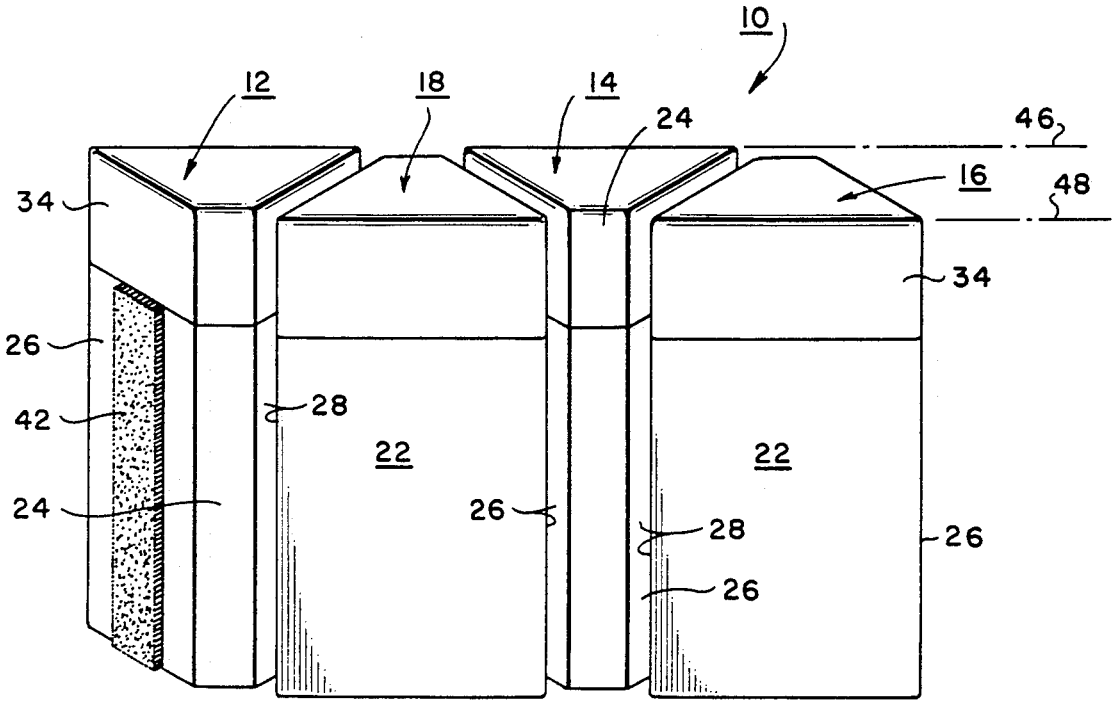
FIG. 7 is a perspective elevation of the assembled personal care package hereof in an alternative embodiment.

For the alternative assembled package of FIG. 7, the same individual containers 12, 14, 16 and 18 are assembled alternately staggered in an interfitting relation. This results in the unit being substantially flat as defined by the parallel planes 46 and 48 of the opposite base surfaces 22. Obviously, the arrangements of either FIGS. 1 or 7 can be selected and interchanged at will by the possessor thereof.

By the above description there is disclosed a novel personal care package by which several personal care items can readily accompany the traveler. By virtue of the configuration and construction of the individual bottles defining the package when assembled, each bottle can be readily removed and restored to the assembly on an as-needed basis with only a minimum of effort. Once assembled, the collectiveness of the bottles represents a unitary structure that is compact in all respects affording a maximum of convenience for luggage packing or hand carrying as desired. The virtues thereof should be instantly appreciated in providing a significant advance in packaging of personal care items for travelers.

Since many changes could be made in the above construction and many apparently widely different embodiments of this invention could be made without departing from the scope thereof, it is intended that all matter contained in the drawings and specification shall be interpreted as illustrative and not in a limiting sense.

What is claimed is:

1. A package of personal care items, comprising:

a plurality of selectively shaped individual containers from which contained personal care commodities can be dispensed;

each of said containers, in section, having a geometrical configuration selected to cooperate with the others of said containers, on being juxtaposed, to effect an arrangement in which said containers, when collectively assembled, complementarily interfit with one another; and attachment means comprising complementary hook and loop strips on the confronting surfaces of the containers to releasably retain said containers in said juxtaposed relationship.

2. A package in accordance with claim 1 in which said containers when assembled are disposed relatively flat between parallel planes.

3. A package of personal care items, comprising:

a plurality of selectively shaped individual containers from which contained personal care commodities can be dispensed;

each of said containers, in section, having a geometrical configuration selected to cooperate with the others of said containers, on being juxtaposed, to effect an arrangement in which said containers, when collectively assembled, complementarily interfit with one another; and attachment means to releasably retain said containers in said juxtaposed relationship;

each of said containers further including a removable cap disposed thereon for accessing the personal care commodity in the container, said cap being of the same sectional configuration as the container on which it is disposed so as to provide exterior surface continuity thereto;

each of said containers having a tubular neck laterally upstanding from an end surface of the container for communicating with the internal storage volume thereof, and said cap rotatably interfits with said neck for opening and closing access to said internal volume.

4. A package in accordance with claim 3 in which the caps of said containers when collectively assembled interlock one another against rotation.

5. The package in accordance with claim 4 in which said containers are trapezoidal in section defining a triangular truncated wedge and there is included an unlike shaped container surrounded by the truncated faces of said like containers.

* * * * *